US005463956A

United States Patent [19]

Harting

[11] Patent Number: 5,463,956

[45] Date of Patent: Nov. 7, 1995

[54] WEAR DECOPPERING LINER

[75] Inventor: Darwin B. Harting, Pekin, Ind.

[73] Assignee: ICI Americas Inc., Valley Forge, Pa.

[21] Appl. No.: 154,922

[22] Filed: Feb. 8, 1994

[51] Int. Cl.[6] ..... F42B 5/16

[52] U.S. Cl. ..... 102/282; 102/435

[58] Field of Search ..... 102/282, 442, 102/435, 511; 42/76.02

[56] References Cited

U.S. PATENT DOCUMENTS

| | | | |
|---|---|---|---|
| 3,282,215 | 11/1966 | Roth | 102/435 |
| 3,392,669 | 7/1968 | Picard | 102/435 |
| 4,098,193 | 7/1978 | Schroeder | 102/435 |
| 4,334,477 | 6/1982 | Axelrod et al. | 102/435 |
| 4,654,093 | 3/1987 | Bolinder et al. | 102/290 |
| 4,712,481 | 12/1987 | Heinrich et al. | 102/435 |
| 4,715,285 | 12/1987 | Höller | 102/511 |
| 5,052,304 | 10/1991 | Rahnenführer et al. | 102/435 |
| 5,151,557 | 9/1992 | Bracuti et al. | 102/435 |

*Primary Examiner*—Charles T. Jordan
*Attorney, Agent, or Firm*—Charles Q. Buckwalter

[57] ABSTRACT

The present invention is directed to a liner comprising a means to decopper, a means to quench heat transfer, and a means to substantially dissolve residue in medium and large caliber guns.

3 Claims, 1 Drawing Sheet

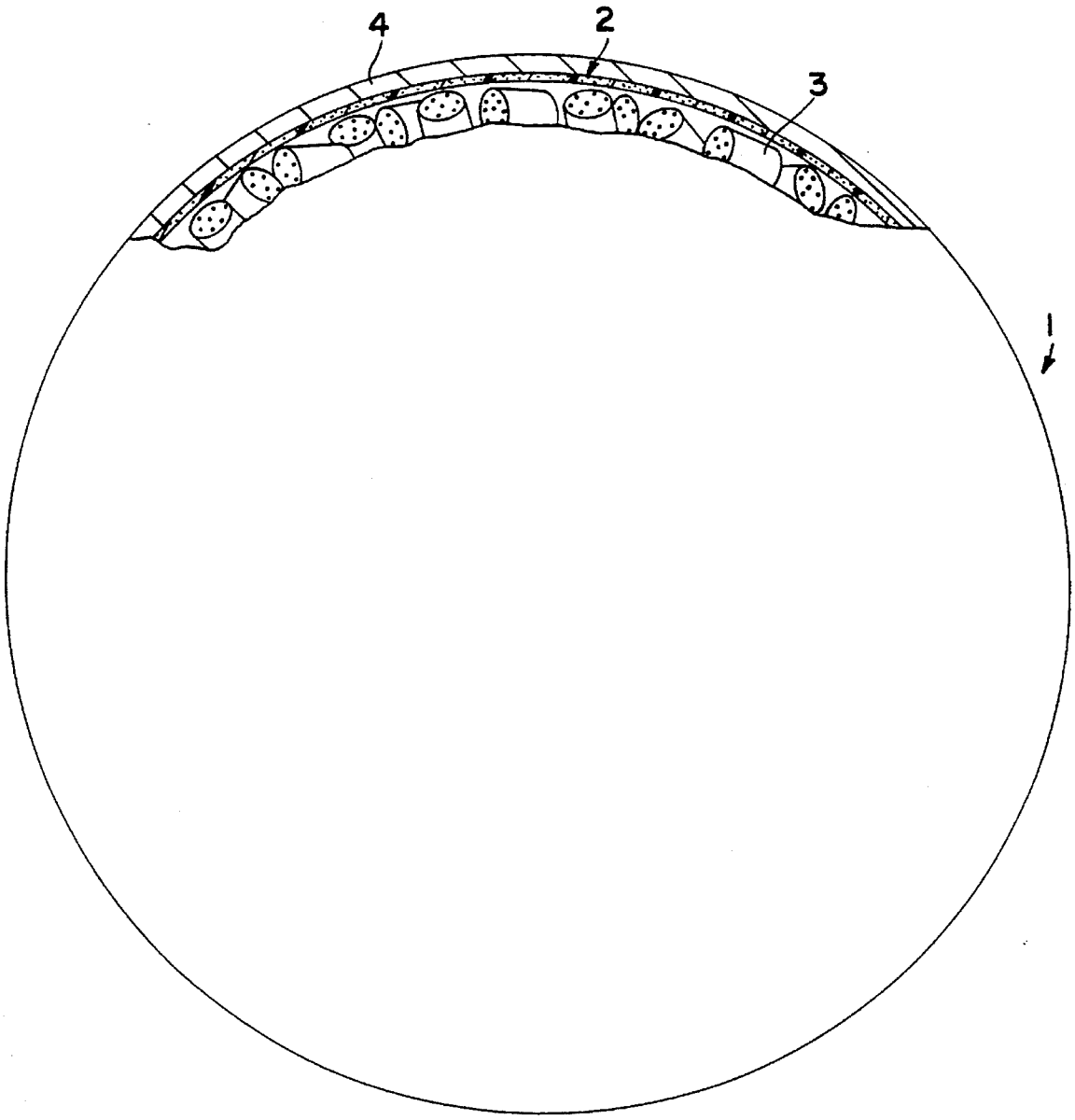
4
2
3
1

WEAR DECOPPERING LINER

BACKGROUND

A purpose of the present invention is directed to an improved liner for the decoppering and reduction of wear for medium and large caliber gun systems. Additionally, this invention is directed to the use of a novel additive in such systems which may be employed in corollary uses.

A problem in the medium and large caliber gun system art is the coppering of rifled gun barrels and wear due to hot gas erosion. In the normal use of rifled gun barrels a projectile is fired, propelled by the ignition of a propellant. As the projectile is ejected from the rifled gun barrel, parts of the rotating band of the projectile are left as a residue on the inside of the barrel. Over an extended usage of such a barrel, the inside portion becomes coated with the residue, a layer of metal such as copper, whereby such coating impacts the ballistics of future fired projectiles.

An additional problem in this art is the hot gas erosion of a portion of the inside of the barrel due to the present system employed for the projectile ejection. After propellant ignition, the hot gases created dissipate or quench the heat generated by propellant ignition through the transfer of thermal energy to the metal barrel. Due to this heat transfer the metal becomes eroded thus decreasing the number of cycles of use of the rifled gun barrel.

The prior art knows of technology intended to remedy the coppering problem. As well, the prior art knows of technology to dissipate the heat. Both decoppering the inside of the barrel and heat dissipation or quenching without significant erosion of the inside of the barrel are accomplished with the present invention.

An additional problem in this art is the disposal of the residue remaining after the propellant has been spent. Generally, this residue remains in the chamber thus fouling the chamber breach mechanism or barrel. The present invention makes use of an additive to insure the substantial dissolution of the liner material.

The present invention is useful for medium and large caliber gun barrels, in particular, but may be found convenient in an environment wherein it is desired that the packaging materials of propellants leave no or little residue, and in the event that an additive is needed to quench heat.

DESCRIPTION OF THE FIGURE

The FIGURE is a cross-sectional view of a propellant unit which shows liner placement around the entire unit.

SUMMARY OF THE INVENTION

A liner comprising a means for decoppering the inside portion of medium and large caliber guns, a means for quenching heat transfer to the inside portion of said gun barrel during and after the initiation of propellant for projectile ejection from said gun, and a means to substantially dissolve residue from said liner. The liner may comprise a substrate subsequently coated with a plastic binder said binder comprising the means for decoppering and the quenching means for said heat transfer on the inside of the gun barrel. The substrate is comprised of any material that is moldable, flexible, resilient, ductile, and/or consumable in use. Said material may be selected from fabric such as silk, rayon, acrylics, cellulosic type material, polymeric materials such as thermoplastic, thermoset, and materials which are combinations thereof. Advantageously, said liner need not be a combination substrate and layered material, instead the coating may be extruded and/or formed into a self-sustaining structure and used in a manner similar to the above stated coated substrate combination. It is preferred that said liner is comprised of a coated substrate fabric material, most preferably the substrate is silk subsequently combined with said means for decoppering and quenching said heat transfer.

In operation, the liner need only be placed proximate to said propellant and vicinal to the base of said projectile. Additionally, the liner may be located within a propelling charge container. Preferably, said liner is located juxtaposed to said propelling charge container and said propellant which are proximate and in communication with the inside of the gun barrel.

Importantly, the liner should not become unduly brittle at low temperature, such as about −50 degrees centigrade, and should not become unduly softened at high temperatures such as about 65 degrees centigrade. These temperature regimes result in poor ballistic performance, an undesirable result.

The means for decoppering and quenching heat is provided by an additive to the liner. The additive may be comprised of compounds from the first, second, and third transition series of metals from the Periodic Chart, but especially the transition series metals of Group VB, such as bismuth, indium, and antimony, of the Periodic Chart and combinations thereof and therebetween. In addition other compounds from metals such as tin, lead, arsenic can be advantageously combined with the Group VB transition metals to form the inventive additive. These metals may be combined as oxides, carbonates, sulfates, halides, sulfides, phosphates, aluminates, silicates, borates, and a combinations thereof, to name a few. The preferable metal compounds are those combined with bismuth. The most preferable is bismuth oxide.

In part, the choice of metal compound is directed by the property related to alloying or complexing with copper. The alloying and/or complexing propensity with copper is then dovetailed with the ability of the metal compound material to dissipate or quench heat within the gun barrel. It is opined that the decoppering mechanism comprises an embrittlement so that the deposited copper combines with the metal compound in some way and this combination subsequently, either in whole or in part, ejected with the next projectile ejectment. With continued use of the inventive additive, the barrel is continually scrubbed thus maintaining the ballistic integrity of the barrel by avoiding the coppering problem.

The heat dissipation or quenching is believed to be caused by the transfer of thermal energy from the hot-gases derived from propellant ignition which is subsequently transferred to the additive metal compound and to a lesser extent a binder. As a result of this heat transfer, less heat reaches the gun barrel thereby partially quenching the heat transfer by dissipating the heat to another heat transfer sink. As a result, the inside of the gun barrel receives less heat which decreases the erosion of the inside of the gun barrel.

A medium caliber gun is defined as a gun barrel of a least 25 mm diameter, whereas a large caliber gun is defined as a gun barrel of a least 50 mm diameter.

The composition of the bismuth additive ranges from about 10 to 90 weight percent bismuth trioxide, more preferably about 40 to 70 weight per cent, and most preferably about 57 to 63 weight per cent. The bismuth oxide was obtained from Metal Specialties Inc. in Fairfield Conn. Combinations of other metals with bismuth, especially those in the Group VB series cited above, may be mixed and/or compounded with the bismuth compound or oxide and found to be as effective. The remaining components comprise about: 5 to 40 weight per cent, preferably 10 to 30, mos preferably 19 to 23 weight per cent potassium salts of oxidized wax. This oxidized wax was obtained from Petrolite Specialty Polymers Group in Tulsa, Okla.; 2 to 20 weight per cent, preferably 4 to 15 weight per cent, and most preferably 5 to 9 weight per cent oxidized microcrystalline wax. This microcrystalline wax was obtained from Petrolite Specialty Polymers Group in Tulsa, Okla.; 2 to 20 weight per cent, more preferably 4 to 15 weight per cent, and most preferably 7 to 11 weight per cent N-butyl-2-nitratoethyl nitramine. This butyl NENA was obtained from ICI Explosives USA Inc. in Tamaqua, Penn.; 1 to 10 weight per cent, more preferably 2 to 7 weight per cent, and most preferably 2 to 4 weight per cent terpine resin, the terpine resin was obtained from Arizona Chemical Company in Panama City., Fla., and residual solvent of less than 1 per cent by weight. The Table shows additional compositions investigated for the present invention.

The waxes used as a component hereinabove are commonly known to those skilled in this art. In particular, a Polymekon modified wax is used comprised of clay treated microcrystalline waxes which are oxidized then treated with potassium salt and oxidized ethylene homopolymer potassium salt. Additionally, Cardis 320 is used which is oxidized clay treated microcrystalline wax containing polyethylene.

The means to substantially dissolve residue is effected through the use of a plasticizer. The plasticizer may be selected from N-butyl 2-nitratoethyl nitramine, other alkyl substituted nitramines and nitrate esters such as nitroglycerin, trimethylolethane trinitrate, triethyleneglycol dinitrate, propyleneglycol dinitrate, ethyleneglycol dinitrate, dinitroxy-diethyl-nitramine, diethyleneglycol dinitrate, 1,2,4-butanetriol trinitrate, bis(2,2-dinitropropyl) acetal or formal. The most preferable is N-butyl 2-nitratoethyl nitramine. In use, the plasticizer releases sufficient energy to substantially dissolve residue in the gun barrel chamber.

The Figure shows a propellant unit, 1, comprising propellant, 3, the liner 2, and the outer cover, 4. This Figure shows the preferred placement of the liner, however, the liner may be placed in other locations within the propellant unit or outside thereof.

In its most general aspect, the process used to make the above composition is one known to those skilled in this art. The process comprises mixing the components in a proportionate amount to form a paste type consistency, combining or spreading the admixture to the substrate material, drying the combination and then adding the combination to the propellant package as shown in the Figure.

WSAR/DECOPPERING LINER EXPERIMENTAL BATCHES
SAMPLES

| | 1 | 2 | 3 | 4 | 5 | 6 | 7 | 8 | 9 | 10 | 11 | 12 | 13 |
|---|---|---|---|---|---|---|---|---|---|---|---|---|---|
| INGREDIENTS | | | | | | | | | | | | | |
| POLYMEKON | 90 | 80 | 89.5 | 60 | 70 | 55 | | | | | 34 | 28 | 20 |
| CARDIS 370 | | | | | | | | | 50 | 33.3 | 12 | 18 | 20 |
| CARDIS 320 | | | | | | | | | | | | | |
| STEARYL ALCOHOL | | | 1 | | | | | | | | | | |
| ZONATAC 85 LITE | | | | | | | | 50 | | 33.3 | 14 | 14 | 20 |
| ZONAREZ | | | | | | | | | | | | | |
| BISMUTH TRIOXIDE | | | | 30 | 30 | 30 | 30 | | | | 30 | 30 | 30 |
| BUTYL NENA | | | | | 10 | | 15 | 50 | 50 | 33.3 | 10 | 10 | 10 |
| PEGON | 10 | 20 | 9.5 | 10 | | | | | | | | | |
| PEG 200 | | | | | | | | | | | | | |
| MINERAL OIL | | | | | | | | | | | | | |
| K-XYLENE* | | | | | | | | | | | | | |
| TRICHLOROETHYLENE* | | | | | | | | | | | | | |

| | 14 | 15 | 16 | 17 | 18 | 19 | 20 | 21 | 22 | 23 | 24 | 25 | 26 |
|---|---|---|---|---|---|---|---|---|---|---|---|---|---|
| INGREDIENTS | | | | | | | | | | | | | |
| POLYMEKON | 22 | 24 | 26 | 32 | 38 | 21 | 21 | 21 | 21 | 21 | 21 | 21 | 21 |
| CARDIS 370 | 18 | 18 | 16 | 16 | 12 | 7 | | | | | | | |
| CARDIS 320 | | | | | | | 7 | 7 | 7 | 7 | 7 | 7 | 1.75 |
| STEARYL ALCOHOL | | | | | | | | | | | | | |
| ZONATAC 85 LITE | 20 | 18 | 18 | 12 | 5 | 3 | 3 | 3 | 3 | 3 | 3 | | |
| ZONAREZ | | | | | | | | | | | | 3 | 0.75 |
| BISMUTH TRIOXIDE | 30 | 30 | 30 | 30 | 30 | 60 | 60 | 60 | 60 | 60 | 60 | 60 | 50 |
| BUTYL NENA | 10 | 10 | 10 | 10 | 15 | 9 | 9 | | 9 | 9 | | 9 | 2.25 |
| PEGON | | | | | | | | | | | | | |
| PEG 200 | | | | | | | | | | 9 | | | |
| MINERAL OIL | | | | | | | | 9 | | | | | |
| K-XYLENE* | | | | | | | | | 15.5 | | | | |
| TRICHLOROETHYLENE* | | | | | | | | | | 20 | | | |

*ML ADDED

I claim:

1. An additive for a liner proximate to a propellant for medium and large caliber guns wherein said additive is comprised of about 10 to 90 weight per cent bismuth trioxide, 5 to 40 weight per cent potassium salt of oxidized wax, 2 to 20 weight per cent oxidized microcrystalline wax, 2 to 20 weight per cent plasticizer, 1 to 10 weight per cent terpene resin, and less than 1 weight per cent residual solvent.

2. The additive of claim 1 wherein said plasticizer is selected from alkyl substituted nitramines such as N-butyl 2-nitratoethyl nitramine, nitrate esters such as nitroglycerin, propyleneglycol dinitrate, ethyleneglycol dinitrate, dinitroxy-diethyl-nitramine, diethyleneglycol dinitrate, 1,2,4-butanetriol trinitrate, bis(2,2-dinitropropyl) acetal or formal and combinations thereof.

3. The additive in claim 1 where saidditive comprises about 57 to 63 weight per cent bismuth trioxide, 19 to 23 weight per cent potassium salt of oxidized wax, 5 to 9 weight per cent oxidized microcrystalline wax, 7 to 11 weight per cent N-butyl-2-nitratoethyl nitramine, 2 to 4 weight per cent terpene resin, and less than 1 weight per cent residual solvent.

* * * * *